United States Patent [19]

Gunter

[11] 4,057,877

[45] Nov. 15, 1977

[54] WASTE CLEANING IMPROVEMENT FOR CARDING MACHINES

[75] Inventor: Josef K. Gunter, Durham, N.C.

[73] Assignee: Gunter & Cooke, Inc., Durham, N.C.

[21] Appl. No.: 692,649

[22] Filed: June 4, 1976

[51] Int. Cl.[2] ..... D01G 15/82

[52] U.S. Cl. ..... 19/107

[58] Field of Search ..... 19/107; 15/300 R, 301

[56] References Cited

FOREIGN PATENT DOCUMENTS

| | | | |
|---|---|---|---|
| 565,905 | 12/1944 | United Kingdom | 19/107 |
| 1,019,768 | 2/1966 | United Kingdom | 19/107 |
| 261,949 | 11/1970 | U.S.S.R. | 19/107 |

*Primary Examiner*—Dorsey Newton

[57] ABSTRACT

An improvement for collecting waste in a carding machine beneath the feed and lickerin rolls having a plenum chamber and duct with an inlet nozzle and a downwardly sloping collecting chute, and side doors enclosing a lickerin waste-collecting chamber provided with an opening through which air flow currents are induced to flow transversely and downwardly to remove and cause the flow of waste downwardly to the inlet nozzle of the plenum chamber.

1 Claim, 3 Drawing Figures

WASTE CLEANING IMPROVEMENT FOR CARDING MACHINES

BACKGROUND, ADVANTAGES AND OBJECTIVES OF THE INVENTION

The collection and removal of waste in a carding machine manually involves substantial time and effort. Removing the waste collected in the chamber beneath the feed and lickerin rolls of a carding machine normally require that the side doors be opened periodically and the waste removed manually or by means of vacuum devices.

Some improvements have been made for continuously and automatically removing the waste that is collected in the lickerin chamber by the installation of a duct that forms a plenum chamber to which a vacuum is applied with the ductwork being provided with an inlet nozzle located preferably at the base of the lickerin waste chamber and an inclined chute that will tend to collect the waste deposited from the feed and lickerin rolls in the chamber which would gradually be urged by air currents from within a plenum chamber by an induced draft fan or other suitable means to remove the waste through the inlet nozzle at the base of the plenum chamber through air currents.

However, there has been a tendency for the waste in the lickerin chamber to accumulate on the inclined chute at the corners which tend to pack and to ultimately clog for the removal of the waste after prolonged periods of operation since the flow of induced air currents is generally longitudinal through the carding machine and the plenum chamber relative to the inlet nozzle.

Therefore, it is the objective of this invention to provide an improvement for removing waste that is collected in the lickerin chamber by generating cross air currents closely adjacent to the waste collecting inclined chute in the lickerin chamber that will sweep the waste collected at remote locations to prevent objectionable accumulations of lint and waste particles.

Another objective of this invention is to provide an improvement for presently available lint and waste collecting systems for carding machines by providing, in the same system, air cross currents in conjunction with longitudinal currents for generating turbulence in those areas where waste has collected normally and has been difficult to remove by present systems.

Yet another objective of this invention is to provide a simple and inexpensive means for providing air cross currents for cleansing certain areas within a lickerin chamber to remove lint and waste and causing it to flow into a collection chamber through a nozzle positioned in the lickerin waste-collecting chamber beneath the lickerin and feed rolls.

Other objectives and advantages of this improvement will become more readily apparent to those skilled in the art of carding taken in conjunction with the accompanying drawing and detailed description of one preferred embodiment of this invention, and the claims which are not intended to be limited to the preferred embodiment.

BRIEF DESCRIPTION OF THE DRAWING OF A PREFERRED EMBODIMENT

DETAILED DESCRIPTION OF PREFERRED EMBODIMENT OF THE INVENTION

Figure 2:
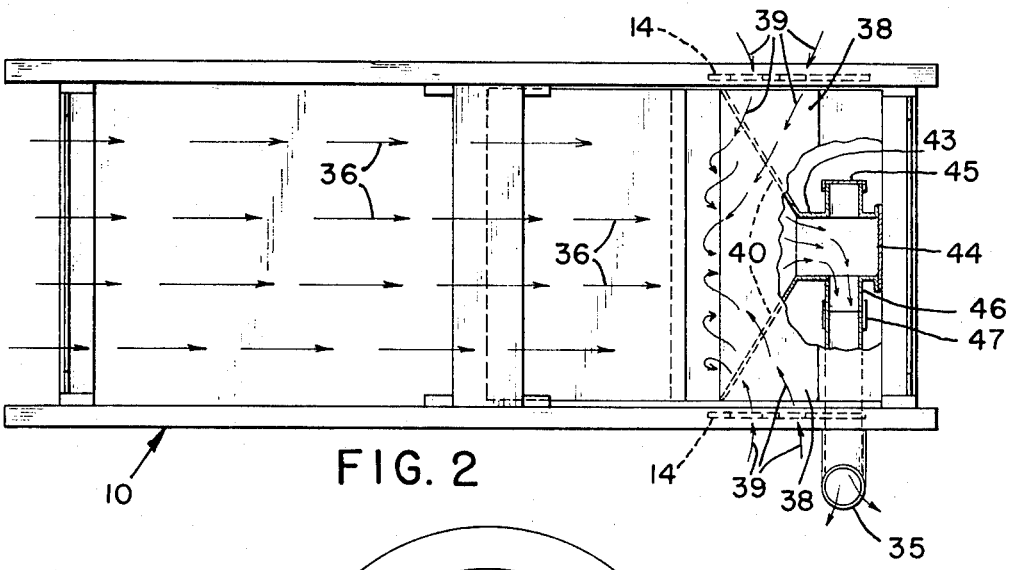
FIG. 2 is a top plan view of only the lower portion of the carding machine embodying the improvement and illustrating the flow of air currents for cleaning and removing waste in the lickerin waste-collecting chamber with a portion of the ductwork removed.
Figure 1:
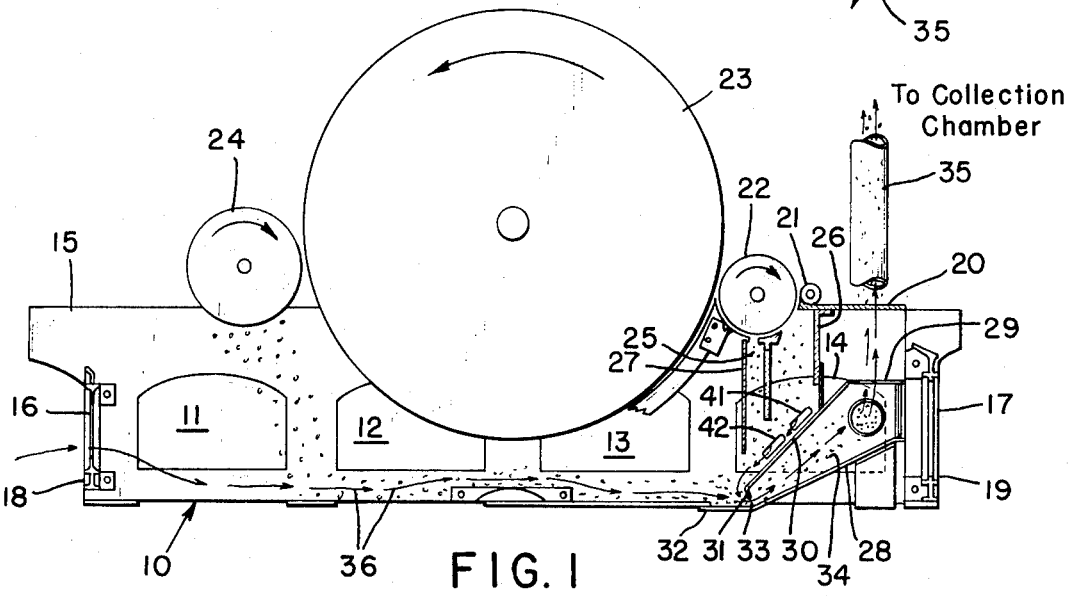
FIG. 1 is a diagrammatic side elevational view of a carding machine incorporating the improved waste cleaning system of this invention with parts omitted and others shown in outline form only.

Referring particularly to FIG. 1, a carding machine frame 10 of conventional construction is shown in which there are side door members 11 through 14 supported on each of the side frame members 15 with end doors 16 and 17 in the opposite ends 18 and 19 of the base carding machine frame 10.

A lap roll of the fiber to be carded (not shown) is fed over the plate 20 to the feed roll 21 in its path of travel to the lickerin roll 22 before transfer of the web to a carding cylinder 23 for carding beneath a series of flats (not shown) prior to removal by a doffer roll 24, all of which is basically conventional practice for the operation of a carding machine.

A lickerin waste chamber 25 is formed between the side walls of frame 10 and the vertical partitions 26 and 27 within which chamber 25 the lickerin waste is discharged downwardly for accumulation and subsequent removal. A vacuum plenum chamber 28 in the form of a laterally extending housing is positioned beneath the plate 20 and extends forwardly into and at the bottom of the lickerin chamber with a horizontal top housing member 29 that connects with a downwardly inclined waste collecting chute 30 at the bottom of which is a downwardly extending lip 31 that cooperates with the forwardly extending trough 32 to form a nozzle or opening 33 therebetween through which waste may be sucked inwardly into the plenum chamber 34 by induced air currents emanating from an induced fan (not shown) or other air flow means (not shown) acting through the vertical stack 35 to generate a suction or vacuum through the duct 35 that extends into the chamber 34 in order to create a vacuum or suction effect through the nozzle 33 thereby inducing a flow of air currents longitudinally in the carding frame as illustrated by the arrows 36 and a flow of air currents basically downwardly along the inclined chute 30. That which has been described relates to the prior art that has been found to be deficient to remove lickerin waste efficiently from the lickerin waste collecting chamber and from the base of the carding machine frame by reason of the uni-directional flow of air currents induced through the use of induced draft system passing through the nozzle 33. Accumulations of lickerin waste at the corners of the lickerin waste chamber tend to condense and pack requiring auxiliary means for removing the waste accumulated periodically adjacent to the side doors 14 within the lickerin waste chamber 25. The waste accumulations generally occur adjacent to the sides 38 of the inclined chute 30 which may require opening the side doors 14 and manually dislodging masses of packed waste.

Figure 3:
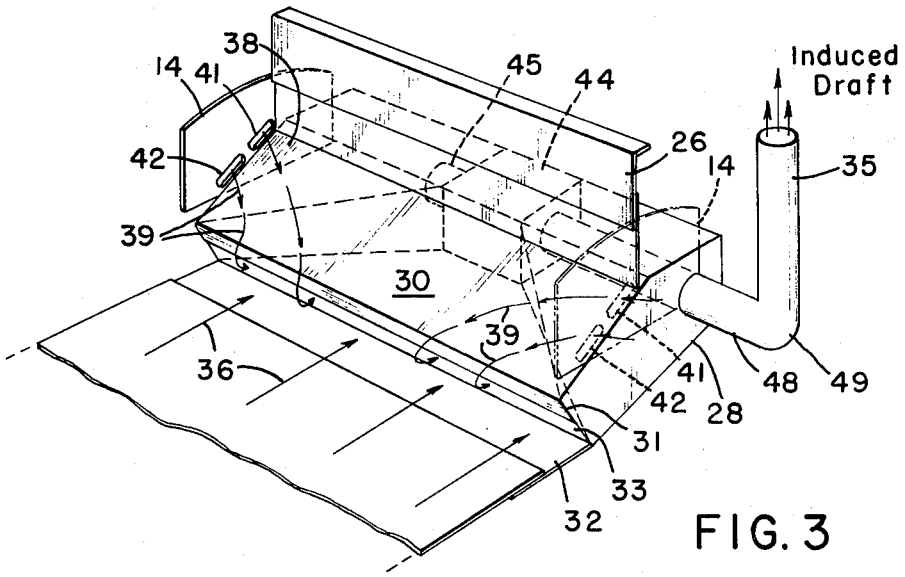
FIG. 3 is an enlarged partial perspective view of the plenum chamber and ductwork below the lickerin and feed rolls with the side door openings for inducing air cross current flow.

It has been found highly advantageous to overcome the problems encountered of waste accumulation on the inclined chute 30 by providing cross currents 39 of air without modifying the basic plenum structure or the induced draft system in which the outwardly downverging walls 40 direct the flow of air through the nozzle 33 at the outward extremity by providing one or more openings 41 and 42, preferably elongated as illustrated in FIGS. 1 and 3 in the side doors 14. The elliptically-shaped openings 41 and 42 in the doors 14 are preferably positioned directly above and in juxtaposition to the inclined surface 30 at the upper portion thereof. The induced draft causes a sufficient volume of air to flow at sufficient velocities to sweep and cleanse the critical areas 38 on the chute 30 to force the lickerin waste accumulated downwardly in the direction of and into the inlet nozzle 33 at the base of the plenum chamber 34. The accumulated lickerin waste in the areas 38 will commingle with the other lickerin waste that accumulates in the lickerin waste chamber and be removed readily. The waste collected within the plenum chamber 34 will enter the circular duct 43 which is sealed at its end 44 and capped at one side 45 with the other side 46 being provided with a coupling 47 to be connected with the horizontal section 48 of the discharge duct 46 that is connected by the elbow 49.

The configuration and positioning of the openings 41 and 42 in the side doors 14 may vary considerably depending upon the inclination of the chute 30. Of course, auxiliary forced or induced air currents may be supplied through the side door openings.

I claim:

1. In a carding machine having in series a feed roll, a lickerin roll, a main cylinder, and a doffer roll mounted for rotation on a supporting card frame having closed sides and having a doffer waste collection area having an end wall and said wall in said doffer waste collection area having an opening therein to admit the flow of air longitudinally through said card frame, and a lickerin waste collecting chamber beneath the lickerin and feed rolls, a plenum chamber having a downwardly sloping waste-collecting chute in said lickerin waste-collecting chamber, said chute terminating in a waste-collecting plenum intake nozzle, and a suction exhaust means communicating with said plenum chamber to induce a flow of air longitudinally along the interior of the carding machine frame from the doffer waste and lickerin waste chambers to exhaust said waste to a remote location, side doors mounted on said supporting frame immediately adjacent to said lickerin waste chamber, the improvement comprising at least one elongated sloping opening on each of said side doors at opposite sides of said frame and in juxtaposition and inclined relative to the sloping waste-collecting chute to admit a flow of air therethrough in a cross current flow to the longitudinal flow of air induced to flow through said frame and over said chute to said nozzle thereby sweeping substantially transversely across said sloping chute directly adjacent to said elongated sloping opening to remove downwardly waste normally collected on said chute adjacent to said side doors to said nozzle with other waste collected on said chute.

* * * * *